United States Patent [19]

Moriguchi et al.

[11] 4,091,981

[45] May 30, 1978

[54] POWER DRIVEN PERCUSSION TOOL

[75] Inventors: Seki Moriguchi; Tatsuo Innami; Akira Uno; Hiroki Orikasa; Toshihito Sakaba, all of Katsuta, Japan

[73] Assignee: Hitachi Koki Company, Limited, Japan

[21] Appl. No.: 774,119

[22] Filed: Mar. 3, 1977

Related U.S. Application Data

[63] Continuation-in-part of Ser. No. 639,766, Dec. 11, 1975, abandoned.

[30] Foreign Application Priority Data

Aug. 21, 1975 Japan ..... 50-101588

[51] Int. Cl.[2] ..... B25C 1/04

[52] U.S. Cl. ..... 227/8; 227/130; 227/137

[58] Field of Search ..... 227/8, 9, 10, 11, 130, 227/135, 137, 138

[56] References Cited

U.S. PATENT DOCUMENTS

| | | | |
|---|---|---|---|
| 2,930,041 | 3/1960 | Massacrier | 227/11 |
| 3,095,572 | 7/1963 | Massacrier | 227/11 |
| 3,632,032 | 1/1972 | Termet | 227/10 |
| 3,677,456 | 7/1972 | Ramspeck et al. | 227/8 |

*Primary Examiner*—Granville Y. Custer, Jr.
*Attorney, Agent, or Firm*—Robert E. Burns; Emmanuel J. Lobato; Bruce L. Adams

[57] ABSTRACT

A power driven percussion tool is provided with a rotatable magazine block formed with a plurality of bores about the axis of rotation of the magazine block and is loaded with fasteners such as rivets or nails respectively retained in the bores. When the magazine block is stepwise rotated about its axis the bores are successively brought into alignment with the direction in which the fastener can be driven by a reciprocating hammer. The percussion tool is further provided with safety means for disabling the tool when the tool is not in use or being re-loaded with fasteners.

19 Claims, 14 Drawing Figures

COMPRESSED AIR 90
96
r
68t
142'
156
210'
208
210
98s
176
112
114
98t
168s
166
142
100
98
68
168
168
2π/n 84
66
86
62
216
212
214
106a
114
122
126
116
118
120
124
108
106a
122a
100
104
112
102
110
102
104
96
90
106
106
68
94
88
98
98
208
92
134
140
220
138

POWER DRIVEN PERCUSSION TOOL

BACKGROUND OF THE INVENTION

The present application is a continuation-in-part of the our application Ser. No. 639,766, filed Dec. 11, 1975, entitled "Power Driven Percussion Tool", and now abandoned.

The present invention relates to a percussion tool for driving an elongated fastener into a work and, more particularly, to a power driven percussion tool of the portable type used for driving a fastener such as a rivet, nail, stud or drive screw into a work of, for example, wood, metal or concrete in wood or metal working operation or in building or construction work.

Percussion tools in general are largely broken down into two major categories by the purposes for which the tools are employed - power driven percussion tools mainly used with relatively soft material of, for example, wood and charge loaded or hand driven percussion tools for use with relatively hard material of, for example, concrete. The power driven percussion tool is usually of the portable type and is powered by pneumatic, hydraulic or electrical energy for driving a fastener into a relatively soft work by a single stroke of a reciprocating hammer. The charge loaded percussion tool, which may be a riveting gun or a stud driver, is actuated by explosive charges stored in the tool and drives a fastener into a relatively hard work by successive blows produced by repeated firing of the explosive charges.

One of the drawbacks of a percussion tool using explosive charges is apparently the dangers resulting from the loading, storage and firing of the explosive charges and another drawback is that the tool cannot be loaded with a number of fasteners at a time. On the other hand, a power driven percussion tool of the portable type has drawbacks in that not only the tool cannot be equipped for providing such a capacity as to be capable of driving a fastener into a hard work by a single stroke of the reciprocating hammer but the tool is not adapted for producing successive blows, because of the restrictions inherent in the portable construction of the tool. The hand driven percussion tools are becoming rather obsolete because of their critically low performance efficiencies. The present invention contemplates elimination of all these drawbacks inherent in the conventional percussion tools of any types.

SUMMARY OF THE INVENTION

It is, therefore, an object of the present invention to provide an improved power driven percussion tool which is capable of delivering successive blows and which can be loaded with a number of fasteners at a time.

It is another object of the present invention to provide an improved power driven percussion tool having means which can be loaded with a number of fasteners at a time and which can be easily dismantled from and reassembled to the tool and nevertheless securely held on the main body during use of the tool.

It is still another object of the present invention to provide an improved power driven percussion tool having safety means adapted to prevent the tool from being accidentally or erroneously actuated when the tool is not in use or being conditioned to be reloaded with fasteners.

It is still another object of the present invention to provide an improved power driven percussion tool having means adapted to successively feed a number of fasteners into a predetermined operative position by simple manipulative actions during use of the tool.

In accordance with the present invention, there is provided a power driven percussion tool for driving an elongated fasterner, comprising reciprocating drive means for striking the fastener at one end thereof in forward direction, a generally cylindrical magazine block rotatable about an axis substantially parallel with the aforesaid direction and formed with a plurality of axial bores parallel with the axis of the magazine block and arranged substantially in symmetry about and with respect to the axis of the magazine block for being successively brought into alignment with the aforesaid direction when the magazine block is stepwise rotated about the axis of the magazine block, each of the above-mentioned bores being adapted to releasably retain a fastener therein, a magazine holder for detachably supporting the magazine block thereon while allowing the magazine block to rotate about its axis, and a manipulator movable relative to the magazine block and the magazine holder between a first position operative to hold the magazine block in a rotational position having one of the aforesaid bores aligned with the aforesaid direction, a second position operative to hold the magazine block in a rotational position having one of said bores misaligned with said direction and a third position allowing the magazine block to be detached from the magazine holder. The percussion tool according to the present invention may further comprise pressure accumulating means for storing therein fluid under pressure and valve means operative to apply the fluid under pressure onto the previously mentioned reciprocating drive means for actuating the drive means into reciprocating motion, the valve means including a fluid discharge valve responsive to the movement of the manipulator out of the first position thereof for discharging the fluid under pressure out of the valve means and thereby disabling the drive means for being actuated into the reciprocating motion. The above-mentioned fluid may be compressed air or hydraulic fluid under pressure so that the percussion tool is pneumatically or hydraulically powered.

The magazine block may have a flange portion formed with a continuous cam track extending generally in zigzag form round the entire circumference of the flange portion. In this instance, the above-mentioned manipulator has fixedly secured thereto a pin engaging the cam track when the manipulator is in the previously mentioned first position or moving between the first and second positions thereof. When the manipulator thus arranged is being moved between the first and second positions thereof, the magazine block is forcibly rotated about its axis into rotational positions having its bores successively brought into alignment with the aforesaid direction in which the reciprocating drive means is actuated to strike the fastener. The manipulator may be movable between the first and second positions thereof in a direction substantially parallel with the axis of the magazine block, the first position of the manipulator being rearward of the second position thereof. The above-mentioned cam track preferably consists of axial locking track portions parallel with the axis of the magazine block, provided in a number equal to the number of the bores in the magazine block and spaced apart from each other circumferentially of the flange portion of the magazine block through central angles respectively equal to the central angles between the bores in the block, turn-off track portions respectively extending obliquely and forwardly from the locking track portions, turn-back track portions respectively merging obliquely and rearwardly out of the turn-off track portions, each of the turn-back track portions merging into the locking track portion next to that locking track portion in which the turn-off track portion merging into the turn-back track portion originates, intermediate corner spots each joining the adjacent turn-off and turn-back track portions, and a retract track portion extending axially forwardly from one of the corner spots and terminating at the front end of the flange portion of the magazine block.

As an alternative to the continuous cam track thus formed, the flange portion of the magazine block may be formed with axial grooves parallel with the axis of the magazine block. The axial grooves are provided in a number equal to the number of the bores in the magazine block, spaced apart from each other circumferentially of the flange portion through central angles respectively equal to the central angles between the bores in the magazine block, and terminate at the front end of the flange portion of the magazine block. In this instance, the manipulator is movable between the previously mentioned first and second positions thereof in a direction substantially parallel with the axis of the magazine block and has fixedly secured thereto a pin which is engageable with any one of the grooves in the flange portion of the magazine block when the manipulator is in the first position thereof or being moved between the first and second positions thereof. The first position of the manipulator thus arranged is rearward of the second position of the manipulator.

The magazine block may be further provided with a boss formed with a hole substantially coaxial with the magazine block per se and a radial groove which is open at both ends thereof, viz., at the outermost and innermost perimeters of the boss. In this instance, the magazine holder has carried thereon a plunger which is biased to axially project into the hole in the boss of the magazine block so that the magazine block is retained to the magazine holder through engagement between the boss and the plunger and is detachable from the magazine holder when the radial groove is directed opposite to the direction in which the magazine block is moved away from the magazine holder and accordingly the plunger on the magazine holder is disengaged from the boss through the radial groove therein.

The manipulator may be rotatable between the second and third positions thereof about an axis which is substantially perpendicular to the axis of the magazine block retained in the magazine holder.

The percussion tool thus constructed and arranged may be further provided with biasing means for urging the manipulator from the second position toward the first position thereof and/or resilient retaining means detachably mounted on the magazine holder for releasably retaining a fastener in each of the bores in the magazine holder.

BRIEF DESCRIPTION OF THE DRAWINGS

The features and advantages of the power driven percussion tool according to the present invention will become more apparent from the following description taken in conjunction with the accompanying drawings, in which like reference numerals designate corresponding or identical portions, members, structures and units throughout the figures and in which.

DESCRIPTION OF THE PREFERRED EMBODIMENTS

Before entering into detailed description of the present invention, it may be noted that, while the present invention will be described as being embodied in a pneumatically driven percussion tool, this is merely for the purpose of the illustration of the gist of the present invention and, for this reason, the basic concepts of the present invention may be applied, either in part or totally and either without substantial change or with any suitable modification, to any other types of power driven percussion tools including hydraulically powered or electrically powered percussion tools and percussion tools using explosive charges and actuating means. The construction and arrangement of the hammering means and the associated valve and shock absorbing means to be described herein are also solely for the purpose of illustration alone and may therefore be modified by those skilled in the art.

Figures 1, 2:
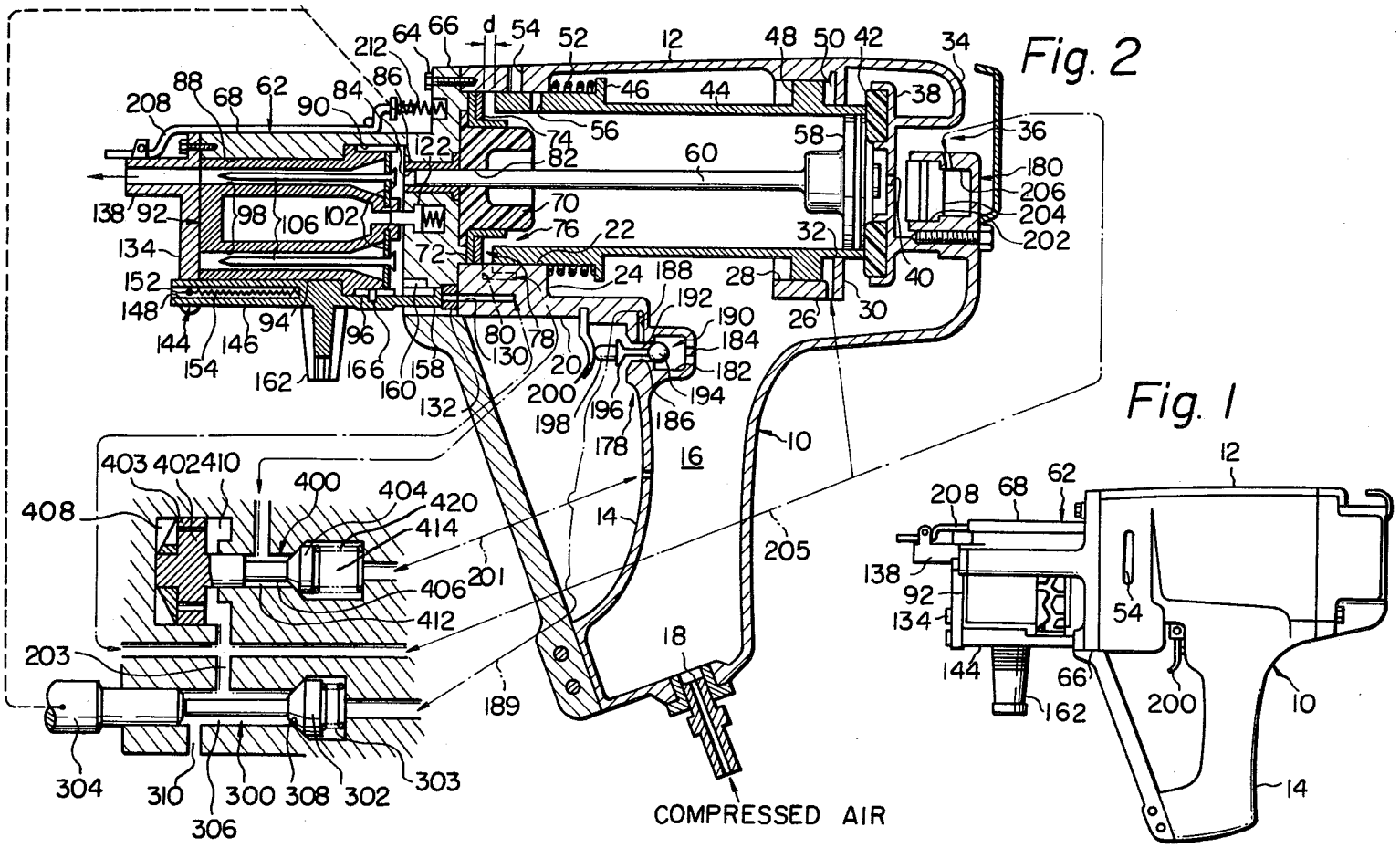
FIG. 1 is a schematic side elevation of a preferred embodiment of a power driven percussion tool according to the present invention, the side elevation showing an overall external appearance of the tool.
FIG. 2 is a longitudinal sectional view showing the details of the internal construction of the percussion tool illustrated in FIG. 1, wherein valve means for controlling the actuation of the tool are schematically illustrated.

Referring now to the drawings, first particularly to FIGS. 1 and 2, a valve type pneumatic percussion tool or rivetter embodying the present invention comprises a rigid, hollow casing structure 10 which consists of a generally cylindrical main body 12 and a handle portion 14 projecting laterally from an intermediate portion of the main body 12. The casing structure 10 has formed partly in the main body 12 and partly in the handle portion 14 thereof a pressure accumulating chamber 16 having an air inlet port 18 which is in communication with a source of compressed air through a flexible tube or any other suitable passageway means (not shown). The main body 12 has a front wall portion 20 having a cylindrical inner peripheral surface 22 which is radially outwardly stepped at its rear end to form an annular end face 24. The main body 12 has further formed in a rear portion of its interior a generally ring-shaped internal wall portion 26 having a cylindrical inner peripheral surface 28 having a center axis which is substantially in line with the center axis of the cylindrical inner peripheral surface 22 of the front wall portion 20 of the main body. The ring-shaped internal wall portion 26 is open at its front end and has formed at its rear end an annular end wall 30 having a circular inner peripheral surface 32, the center axis of which is also in line with the center axis of the inner peripheral surface 22 of the front wall portion 20 of the main body 12. The main body 12 further has a rear wall portion 34 which is turned back inwardly or forwardly of the main body, forming a concavity 36 which is open to the atmosphere at the rearmost end of the main body. The thus turned rear wall portion 34 of the main body 12 forms at its innermost end a disc-shaped wall portion 38 which is located rearwardly of and in proximity to the annular end wall 30 of the above-mentioned ring-shaped internal wall portion 26 and which is formed with an opening 40 for providing communication between the interior of the main body 12 and the concavity 36 formed by the rear wall portion 34. The disc-shaped wall portion 38 has fixedly attached to the inner or front face thereof an annular rear seat member 42 which is formed of a resilient material and which is secured to the entire inner circumference of the annular end wall 30 of the ring-shaped internal wall portion 26.

A hollow cylinder 44 has front and rear end portions received in an air-tight fashion in the front wall portion 20 and the annular end wall 30 of the ring-shaped internal wall portion 26, respectively, of the main body 12 and is axially slidable on the cylindrical inner peripheral surface 22 of the front wall portion 20 and the circular inner peripheral end 32 of the annular end wall 30, having a rearmost end axially projecting rearwardly from the annular end wall 30 toward the annular resilient member 42 on the disc-shaped wall portion 38. The cylinder 44 has flange portions 46 and 48 which are axially spaced apart from each other on the outer peripheral surface of the cylinder. One flange portion 46 is formed on an intermediate part of the cylinder 44 and is axially spaced apart from the annular rear end face 24 of the front wall portion 20 of the main body 12, and the other flange portion 48 is located in proximity to the rear end of the cylinder 44 and is axially slidably received on the cylindrical inner peripheral surface 28 of the ring-shaped internal wall portion 26 of the main body 12. The rear flange portion 48 has front and rear end faces which have substantially equal areas while the intermediate flange portion 46 has a rear end face which is larger in area than the front end face thereof. The front portion of the cylinder 44 is thus shown having an enlarged outside diameter. Between the rear end face of the rear flange portion 48 of the cylinder 44 and the front face of the annular end wall 30 of the ring-shaped internal wall portion 26 is formed an annular gap 50 which encircles a rear part of the cylinder 44 and which is hermetically sealed off from the pressure accumulating chamber 16 in the casing structure 10 (means being however provided to provide communication between the gap 50 and the chamber 16 during operation of the tool or rivetter as will be described later). The annular gap 50 is contracted and expanded as the cylinder 44 is axially moved and accordingly the rear flange portion 48 thereof is axially moved toward and away from the annular end wall 30 of the ring-shaped internal wall portion 26 of the main body 12. The cylinder 44 is rearwardly movable until the rearmost end thereof is brought into abutting engagement with the annular rear seat member 42 on the disc-shaped wall portion 38 of the main body 12. The cylinder 44 is urged rearwardly by a suitable biasing means which is herein shown to consist of a helical compression spring 52 seated at one end on the annular rear end face 24 of the front wall portion 20 of the main body 12 and at the other end on the annular front end face of the intermediate flange portion 46 of the cylinder 44. The compression spring 52 is selected to have a spring constant which is merely effective to hold the cylinder 44 in an axially suspended condition within the main body 12 in the absence of air pressure in the pressure accumulating chamber 16 in the casing structure 10. Thus, the spring 52 practically does not lend itself to the movement of the cylinder 44 and, for this reason, the biasing force thereby exerted on the cylinder 44 may be disregarded in the presence of air pressure in the pressure accumulating chamber 16. The cylinder 44 is movable forwardly from the rearmost axial position until it reaches a predetermined foremost axial position which is determined by means to be described later. The distance of stroke (indicated by *d* in FIG. 2) of the cylinder 44 between the above-mentioned rearmost and foremost axial positions is smaller than the distance between the rear face of the annular end wall 30 of the internal wall portion 26 and the outer or front face of the annular rear seat member 42 on the disc-shaped wall portion 38 of the main body 12. The front wall portion 20 of the main body 12 and the front end portion of the cylinder 44 are formed with circumferential slots 54 and 56, respectively, which are so positioned relative to each other that the slot 56 in the cylinder 44 is located rearwardly of the slot 54 in the main body 12 when the cylinder 44 is in the rearmost axial position thereof as illustrated in FIG. 2 and that the slot 56 in the cylinder 44 is aligned with the slot 54 in the main body 12 when the cylinder 44 is moved into the foremost axial position thereof. When the slots 54 and 56 are thus brought into alignment with each other with the cylinder 44 moved into the foremost axial position thereof, communication is established between the interior of the cylinder 44 and the atmosphere through the aligned slots 54 and 56.

A piston 58 is axially movable on the inner peripheral surface of the cylinder 44 toward and away from a rearmost axial position contacting the outer or front face of the annular rear seat member 42 on the disc-shaped wall portion 38 of the main body 12. The rear seat member 42 is thus adapted to hermetically seal off the interior of the cylinder 44 at the rear end of the cylinder when the cylinder is moved into the rearmost axial position contacting the rear seat member 42 and to lessen the shocks which will be transferred from the piston 58 to the casing structure 10 when the piston is moved into the rearmost axial position abutting against the rear seat member 42. An elongated hammer rod 60 projects from the front face of the piston 58 and axially extends through the bore in the cylinder 44 and out of the front end of the cylinder and further out of the front end of the main body 12 which in itself is open at the front end thereof.

A magazine holder 62 is rigidly secured to the front end of the main body 12 by bolts 64 (only one of which is seen in the drawings). The magazine holder 62 consists essentially of a disc-shaped rear wall portion 66 and an elongated front wall portion 68 projecting forwardly from the rear wall portion 66 and having a generally semicircular cross section, as will be seen in FIGS. 3 and 4. The disc-shaped rear wall portion 66 of the magazine holder 62 constitutes a front end wall of the main body 12 and has fixedly attached to its inner or rear end face a generally cup-shaped front seat member 70 partly projecting into the front end portion of the bore in the cylinder 44. The front seat member 70 formed of a resilient material has an outer peripheral surface radially spaced apart from the inner peripheral surface of the front end portion of the cylinder 44 and is secured to the inner or rear face of the disc-shaped rear wall portion 66 of the magazine holder 62 by means of annular brackets 72 and 74. The brackets 72 and 74 closely surround a base portion of cup-shaped front seat member 70 and are fixedly held in position in the vicinity of the front end of the cylinder 44 so as to engage the front end of the cylinder 44 when the cylinder is moved forwardly in the main body 12. Thus, the brackets 72 and 74 not only serve as means embracing the resilient front seat member 70 but provide adjustable stop means dictating the foremost axial position of the cylinder 44 and means to maintain an annular gap 76 between the outer peripheral surface of the resilient member 70 and the inner peripheral surface of the front end portion of the cylinder 44. When the cylinder 44 is moved into the rearmost axial position thereof as illustrated in FIG. 2, the front end of the cylinder 44 is axially spaced apart from the bracket 74 shown located rearwardly of the bracket 72 and forms between the front end of the cylinder and the face of the bracket 74 an annular gap 78 which is contiguous to the above-mentioned annular gap 76 formed between the front seat member 70 and the inner peripheral surface of the cylinder 44. The front wall portion 20 of the main body 12 is formed with a passageway 80 which is open to the annular gap thus formed between the front end of the cylinder 44 and the bracket 74. When the cylinder 44 is moved forwardly from the rearmost axial position thereof and abuts at its front end against the annular bracket 74, then the annular gap 78 is eliminated and the passageway 80 is closed at its terminating end by the outer peripheral surface of the cylinder 44 although the annular gap 76 surrounding the cup-shaped front seat member 70 is maintained. The distance *d* of stroke of the cylinder 44 is, thus, determined by the distance between the front end of the cylinder 44 in the rearmost axial position thereof and the rear face of the annular bracket 74 in the arrangement illustrated in FIG. 2. It is, however, apparent that the combination of the brackets 72 and 74 may be dispensed with if suitable arrangement is otherwise made which will securely hold the front seat member 70 in position and will maintain the annular gap 76 between the seat member 70 and the inner peripheral surface of the cylinder 44 irrespective of the axial position of the cylinder relative to the main body 12 and if the axial displacement of the cylinder 44 is limited to the distance *d*. The front seat member 70 is adapted to dampen the shocks transferred to the magazine holder 62 and the casing structure 10 from the piston 58 which is moved into the foremost axial position thereof to strike the front seat member 70. The front seat member 70 is formed with a central opening 82 having a center axis aligned with the axis of the hammer rod 60, which is slidably passed through the opening 82 and projects forwardly from the front end of the front seat member 70.

The magazine holder 62 has provided in the disc-shaped rear wall portion 66 thereof a through hole 84 which is axially in alignment with the above-mentioned central opening 82 in the cup-shaped front seat member 70 and which is open at the front end of the rear wall portion 66. The hammer rod 60 is thus axially movable through the hole 84 and, when the piston 58 is in the rearmost axial position thereof contacting the rear seat member 42, the hammer rod 60 terminates immediately ahead of the open foremost end of the hole 84 as is seen in FIG. 2. The through hole 84 is shown formed in a sleeve 86 which is fitted into a through hole formed in the wall portion 66 of the magazine holder 62.

Figure 5:
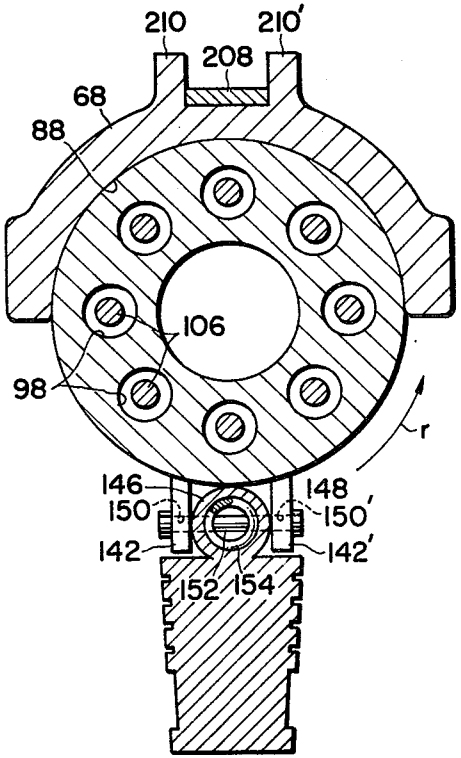
FIG. 5 is a cross sectional view taken on lines V—V of FIG. 3.
Figure 3:
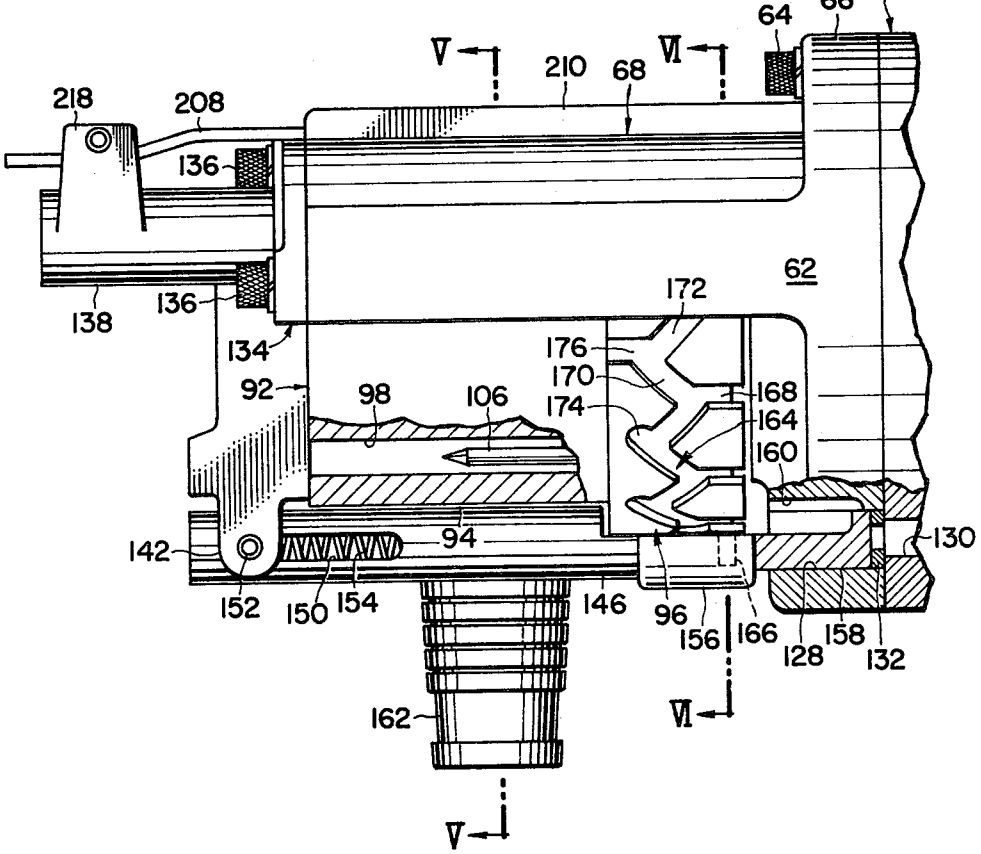
FIG. 3 is a fragmentary exploded view showing, to an enlarged scale, a front part of the percussion tool shown in FIGS. 1 and 2.
Figure 6:
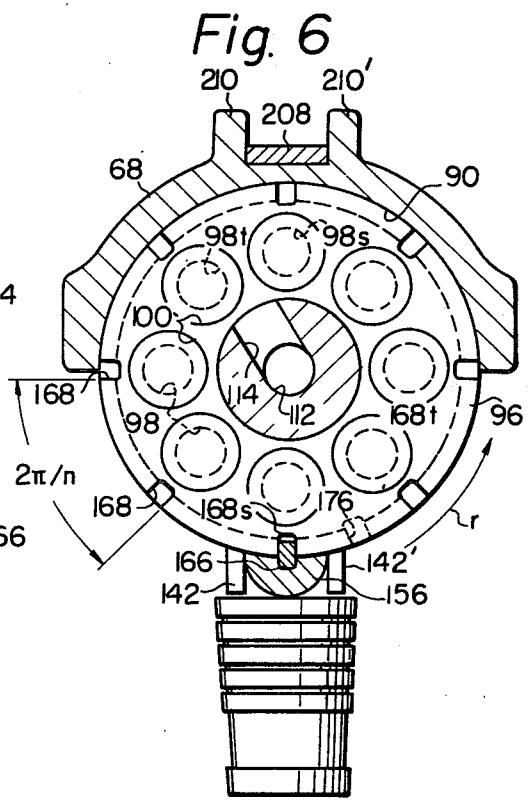
FIG. 6 is a cross sectional view taken on line VI—VI of FIG. 3.
Figure 4:
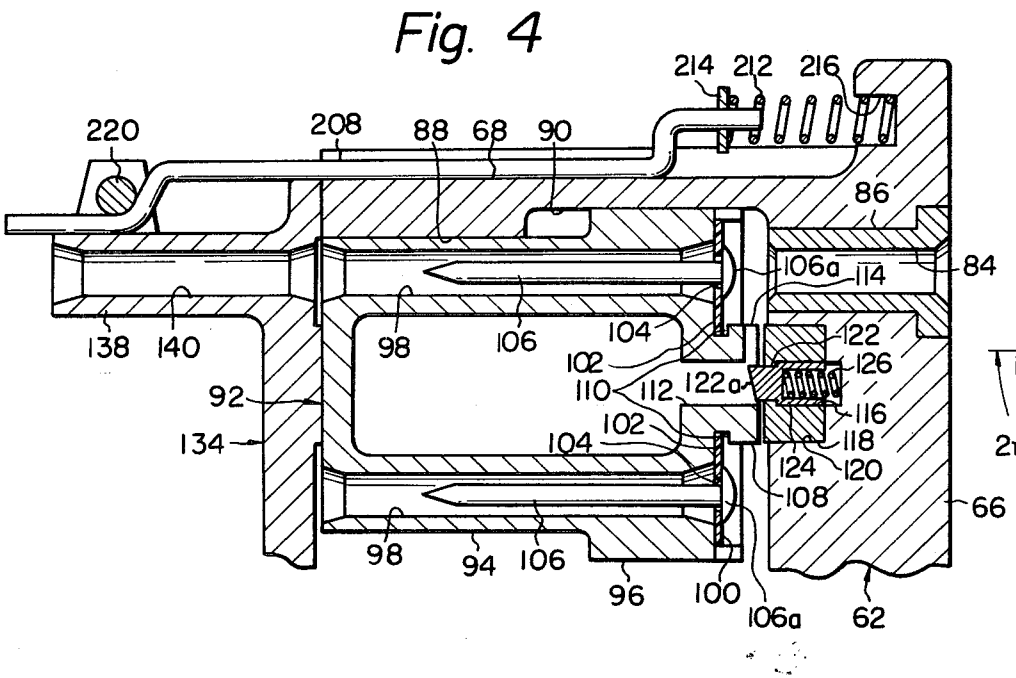
FIG. 4 is a longitudinal sectional view of a portion of the front part of the percussion tool illustrated in FIG. 3.

As illustrated in FIGS. 3 to 6 as well as FIG. 2, the elongated front wall portion 68 of the magazine holder 62 has a semicylindrical front inner surface 88 forwardly terminating at the front end of the wall portion 68 and a semicylindrical rear inner surface 90 which is radially outwardly stepped from the rear end of the front inner surface 88 and which rearwardly terminates at the front end face of the disc-shaped rear wall portion 66 of the magazine holder 62, as will be best seen in FIG. 4. The semicylindrical front and rear inner surfaces 88 and 90 of the wall portion 68 have a common center axis which is parallel with the center axis of the through hole 84 in the rear wall portion 66 of the magazine holder 62. The magazine holder 62 thus configured is adapted to receive on the semicylindrical inner surfaces 88 and 90 of its front wall portion 68 part of a generally cylindrical, detachable magazine block 92 which is rotatable relative to the magazine holder 62 about its center axis which is substantially coincident with the above-mentioned common center axis of the semicylindrical inner surfaces 88 and 90 of the wall portion 68 of the magazine holder 62. The magazine block 92 has a front cylindrical portion 94 circumferentially slidable on the semicylindrical front inner surface 88 of the wall portion 68 of the magazine holder 62 and a rear flange portion 96 circumferentially slidable on the semicylindrical rear inner surface 90 of the wall portion 68. The magazine block 92 is formed with a plurality of bores 98 which are parallel with the center axis of the block 92 and which are arranged substantially symmetrically about and with respect to the center axis of the block. Each of the bores 98 is open at the front and rear ends of the magazine block 92 and has a rear end portion enlarged toward the rearmost end thereof as is seen in FIG. 4. As will be described later, the magazine block 92 is adapted to be stepwise rotated about its center axis relative to the magazine holder 62 so that the bores 98 are successively brought into alignment with the through hole 84 in the rear wall portion 66 of the magazine holder 62 as the magazine block 92 is rotated through a predetermined angle. The bores 98 are shown in FIGS. 5 and 6 as being provided eight in number and are, thus, assumed to be successively brought into alignment with the through hole 84 each time the magazine block 92 is rotated through 45° about its center axis. This is, however, merely by way of example and the number of the bores 98 to be provided in the magazine block 92 may be selected arbitrarily. The magazine block 92 has formed in its rear end wall annular depressions 100 which respectively surround the bores 98. Each of the annular depressions 100 has detachably received thereon an annular retaining member 102 which is formed with a resilient material such as rubber and which is formed with an aperture 104 having a center axis in line with the center axis of the bore 98 contiguous to the retaining member. In use of the tool, fasteners such as rivets or nails 106 each having a head 106*a* at one end thereof are axially inserted into the individual bores 98 in the magazine block 92 through the apertures 104 in the retaining members 102 with the heads 106*a* of the rivets or nails 106 in contact with the respective rear faces of the retaining members 102 as seen in FIGS. 2 and 4. The rivets or nails 106 thus supported by the retaining members 102 have their pointed ends located immediately before the front ends of the respective bores 98. The magazine block 92 is further formed with a boss 108 projecting from a rear center wall portion of the block and terminating in proximity to the front end face of the rear wall portion 66 of the magazine holder 62. The boss 108 has formed in its outer peripheral wall a plurality of recesses 110 which are respectively contiguous to the annular depressions 100 in the rear end wall of the magazine block 92 so that each of the annular retaining members 102 received in each depression 100 is partly captured in each of the recesses 110 and is thus prevented from being dislodged from the magazine block 92 during use of the tool. If desired, the retaining members 102 may be formed as integral portions of a unitary annular member concentrically received on the rear end face of the magazine block 92 or, preferably, in an annular depression or groove formed in the rear end wall of the magazine block 92 about the center axis of the block, though not shown in the drawings.

The boss 108 thus formed on the rear end wall of the magazine block 92 has a hole 112 which is open at the rearmost end of the boss 108 and which has a center axis substantially coincident with the center axis of the magazine block 92. The boss 108 of the magazine block 92 is further formed with a radial groove 114 extending from the hole 112 toward between the rear open ends of two of the bores 98 in the magazine block 98, the particular two bores being designated by 98*s* and 98*t* in FIG. 6 wherein the magazine block 92 is assumed to be rotated counterclockwise of the drawing as indicated by arrow *r* during operation. As illustrated in FIG. 4, the disc-shaped rear wall portion 66 of the magazine holder 62 is provided with a hole 116 which is open at the front end of the wall portion 66 and which is aligned with the hole 112 in the boss 108 of the magazine block 92. For ease of machining, the hole 116 is constituted partly by a bore formed in an insert 118 which is fitted into a hole 120 formed in the wall portion 66. The hole 120 in the wall portion 66 is shown to have a bottom portion contiguous to the bore in the insert 112. A plunger 122 is axially movable through the hole 116 in the insert 120 toward and away from the hole 112 in the boss 108 of the magazine block 92. The hole 116 and the plunger 122 are radially stepped as at 124 so as to prevent the plunger 122 from being moved out of the hole 116 and to limit the forward displacement of the plunger 122. When the plunger 122 is in the foremost axial portion thus determined, the plunger has its front end portion received in the hole 112 in the boss 108 of the magazine block 92 and its foremost end located next the radially innermost end of the radial groove 114 in the boss 108, as illustrated in FIG. 4. The plunger 122 is urged forwardly by a suitable biasing means which is shown to consist of a preloaded helical compression spring 126 seated at one end on the bottom end of the hole 120 in the wall portion 66 and at the other on the bottom of a concavity formed in the plunger 122. The plunger 122 thus projecting into the hole 112 in the magazine block 92 provides a cantilever shaft about which the magazine block is rotatable. As will be described later, the magazine block 92 can be moved laterally away from the inner surfaces of the front wall portion 68 of the magazine holder 62 when the radial groove 114 in the boss 108 of the magazine block 92 is directed toward the circumferential middle point of the semicylindrical inner surface 90 of the wall portion 68. To provide ease in mounting the magazine block 92 on the magazine holder 62 after the block is thus dismantled from the magazine holder, the plunger 122 has a front end face 122*a* which slants rearwardly away from the inner surface 90 of the wall portion 68 of the magazine holder 62 as is seen in FIG. 4 so that the plunger 122 is slidably pressed against the end face of the boss 108 by the force of the spring 126 when the magazine block 92 is being moved toward the wall portion 68 of the magazine holder 62. As illustrated in FIG. 3, the disc-shaped rear wall portion 66 of the magazine holder 62 has formed in its circumferential end located diametrically opposite to the through hole 84 across the center axis of the wall portion 66 a through hole 128 which is open at the front and rear ends of the wall portion 66. The through hole 128 is in communication with a passageway 130 which is formed in the front wall portion 20 of the main body 12 and which is in communication with a safety valve 300 and a return valve 400 (FIG. 2) through passageway 203. Though schematically illustrated in FIG. 2, the safety valve 300 and the return valve 400 are arranged in the main body 12, and the functions of which will be explained hereinafter. An annular seat member 132 is securely fitted in the rear end of the through hole 128.

To the foremost end of the front wall portion 68 of the magazine holder 62 is rigidly secured a front end member 134 by means of bolts 136 (FIG. 3). The front end member 134 has a cylindrical projection 138 formed with an axial bore 140 which is aligned with the through hole 84 in the rear wall portion 66 of the magazine holder 62 and which is accordingly in communication with the hole 84 through one of the axial bores 98 in the magazine block 92 when the magazine block is in an angular position about its axis having the bore located in line with the hole 84 as seen in FIGS. 2 and 4. The front end member 134 further has a pair of spaced parallel lateral projections 142 and 142' extending laterally away from the cylindrical projection 138 and terminating in the vicinity of that circumferential end of the front end wall of the magazine block 92 which is remotest to the front wall portion 68 of the magazine holder 62, as will be seen from FIGS. 2 to 6. In other words, the lateral projections 142 and 142' of the front end member 134 have respective leading end portons located forwardly of the above-mentioned hole 128 in the rear wall portion 66 of the magazine holder 62 at a spacing substantially equal to the axial length of the magazine block 92, as will be seen from FIG. 3.

A magazine manipulator 144 has an elongated rod portion 146 formed with an axial bore 148 which is open at one end of the rod portion and which terminates at a suitable distance from the open end thereof and a pair of elongated slots 150 and 150' which are diametrically opposed to each other and which are open to the axial bore 148 as will be seen from FIGS. 3 and 5. A pin 152 is passed diametrically through the axial bore 148 and projects out of the rod portion 146 through the slots 150 and 150'. The pin 152 is connected between the leading end portions of the spaced parallel lateral projections 142 and 142' of the front end wall 134 so that the manipulator 144 in its entirety is rotatable about the axis of the pin 152 and is axially movable relative to the pin 152 over a distance substantially equal to the length of the elongated slots 150 and 150'. A preloaded helical compression spring 154 is positioned within the axial bore 148 in the rod portion 146 and is seated at one end on the pin 152 and at the other end on the wall surface (as seen in FIG. 2) defining the bottom of the axial bore 148, thereby urging the manipulator 144 axially away from the pin 152 or, when the manipulator is held in a position parallel with the center axis of the magazine block 92 as shown in FIGS. 2 and 3, rearwardly of the pin 152. When the manipulator 144 is held in this position relative to the magazine block 92 mounted on the magazine holder 62, the rod portion 146 of the manipulator 144 is in contact with that circumferential end of the front cylindrical portion 94 of the magazine block 92 which is opposite to the circumferential middle part of the semicylindrical inner surface 88 of the wall portion 68 of the magazine holder 62 as will be best seen in FIG. 5. The manipulator 144 further has an intermediate portion 156 which is offset outwardly of the magazine block 92 in the shown operable position from the rearmost end of the rod portion 146 so as to be in contact with the rear flange portion 96 of the magazine block 92 as shown in FIGS. 3 and 6, the intermediate portion 156 being shown in FIG. 6 as having a semicircular cross section. The manipulator 144 further has a valve portion 158 projecting from the rear end of the intermediate portion 156 and having an enlarged end. The valve portion 158 is axially slidable in the through hole 128 in the rear wall portion 66 of the magazine holder 62 toward and away from the annular seat member 132 fixedly positioned in the hole 128, as will be seen from FIG. 3. The valve portion 158 is urged to be in pressing contact with the front end face of the annular seat member 132 by the force of the preloaded compression spring 154 in the axial hole 148 of the rod portion 146 and accordingly to close the through hole 128 by the enlarged rear end thereof, as illustrated in FIG. 3. The rear wall portion 66 of the magazine holder 62 is formed with an air discharge port 160 which is contiguous to a front portion of the through hole 128 and which is open to the atmosphere at the front end of the wall portion 66. When the manipulator 144 having the valve portion 158 projecting into the through hole 128 is forcibly moved forwardly away from the rear wall portion 66 of the magazine holder 62, the enlarged rear end of the valve portion 158 is unseated from the annular seat member 132 and is moved along the port 160 so that communication is provided between the port 160 and the previously mentioned passageway 130 in the wall portion 20 of the main body through the hole 128. The manipulator 144 is provided with a manipulator handle 162 projecting laterally outwardly from the rod portion 146 so that the manipulator 144 as a whole can be manually moved axially and rotated about the axis of the pin 152. The flange portion 96 of the magazine block 92 is formed with a continuous cam track 164 extending generally is zigzag form round the entire circumference of the flange portion. A pin 66 projects from the intermediate portion 156 of the manipulator 144 into the cam track 164 thus formed in the flange portion 96.

Figure 7:
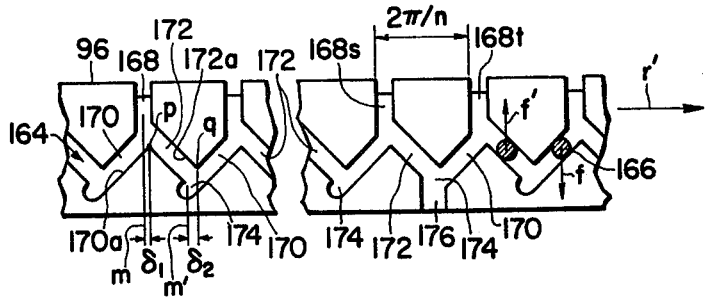
FIG. 7 is a fragmentary development of a cam track arrangement incorporated in the percussion tool illustrated in FIGS. 1 to 4.

As is more clearly shown in FIG. 7, the cam track 164 consists of locking track portions 168, turn-off track portions 170, turn-back track portions 172, intermediate corner spots 174 and a retract track portion 176. The locking track portions 168 extend axially inwardly or forwardly from the rear end of the flange portion 96 and are equidistantly spaced apart from each other circumferentially of the flange portion 96. The turn-off track portions 170 merge out of the locking track portions 168, respectively, and extend obliquely and inwardly or forwardly from the locking track portions 168. The turn-back track portions 172 merge out of the turn-off track portions 170, respectively, and extend obliquely and outwardly or rearwardly from the turn-off track portion 170, each turn-back track portion 172 merging into the locking track portion 168 which is next to that locking track portion in which the turn-off track portion 170 merging into the turn-back track portion 172 originates. The adjacent turn-off and turn-back track portions 170 and 172 have respective terminating and starting ends conjoined by each of the intermediate corner spots 174. One of the intermediate corner spots 174 is open to the retreat track portion 176 which extends axially inwardly or forwardly from the particular corner spot and terminates at the inner or front end of the flange portion 96 as shown. The axial locking track portions 168 are of the same number as the bores 98 (FIG. 4) in the magazine block 92. Assuming, thus, an $n$ number of bores 98 are provided in the magazine block 92, the locking track portions 168 are spaced apart from each other circumferentially of the flange portion 96 through a central angle of $2\pi/n$ about the center axis of the magazine block 92. As illustrated in FIG. 6, furthermore, the individual locking track portions 168 have center lines (indicated by $m$ in FIG. 7) respectively aligned with the center axes of the individual bores 98 in the magazine block 92 in radial directions of the block. When, therefore, the pin 166 on the intermediate portion 156 of the manipulator 144 (FIG. 3) is received in one of the locking track portions 168 of the cam track 164, then the bore located in diametrically opposed relationship to the particular locking track portion is located in alignment with the through hole 84 in the rear wall portion 66 of the magazine holder 62 and with the axial bore 140 in the cylindrical projection 138 of the front end member 134 (FIG. 4). Of the plurality of locking track portions 168 thus arranged, the particular track portions which are in diametrically opposed relationship to the previously mentioned two 98*s* and 98*t* of the bores in the magazine block 92 are designated by 168*s* and 168*t*, respectively, in FIG. 6. The retract track portion 176 is located intermediate between the extensions of the center lines of these particular locking track portions 168*s* and 168*t*, as indicated by a dotted line in FIG. 6. As is further illustrated in FIG. 7, each of the turn-off track portions 170 has a front side guide face 170*a* and, likewise, each of the turn-back track portions 172 has a rear side guide face 172*a*. It is, in this instance, important that, if the magazine block 92 is assumed to be rotated counterclockwise of FIGS. 5 and 6 as indicated by the arrows $r$ so that the flange portion 96 thereof is circumferentially moved rightwardly of FIG. 7 as indicated by an arrow $r'$, the front side guide face 170*a* of each turn-off track portion 170 has an axially rearmost starting end $p$ slightly leading a suitable distance $\delta_1$ from the center line $m$ of the adjacent locking track portion 168 in the direction $r'$ of movement of the flange portion 96 and that the rear side guide face 172 of each turn-off track portions 172 has an axially foremost starting end $q$ slightly trailing a suitable distance $\delta_2$ from the center line (indicated by $m'$ in FIG. 7) of the adjacent corner spot 174.

When the manipulator 144 is in a position having its valve portion 158 received in the through hole 128 in the rear wall portion 66 of the magazine holder 62 with the pin 166 projecting into the cam track 164 in the magazine block 92 supporting on the magazine holder 62, the manipulator 144 is urged rearward by means of the preloaded compression spring 154 so that the pin 166 is located in one of the axial locking track portions 168. If, in this instance, the particular locking track portion 168*s* is in engagement with the pin 166 (FIGS. 6 and 7), then the bore 98*s* in the magazine block 92 is aligned with the through hole 84 in the rear wall portion 66 of the magazine holder 62. When the manipulator 144 is moved forwardly at the manipulator handle 162 against the force of the spring 154, then the pin 166 on the intermediate portion 156 of the manipulator is caused to move forwardly in the locking track portion 168*s* and enters the adjacent turn-off track portion 170. As the manipulator 144 is moved forward, the pin 166 rides forwardly in the turn-off track portion 170 and finally reaches the corner spot 174 in which the track portion 170 terminates. When the pin 166 is thus being moved along the turn-off track portion 170, the pin 166 is forced against the front side guide face 170*a* of the track portion 170 and urges the magazine block 92 axially forwardly as indicated by an arrow $f$ in FIG. 7. As a consequence, the flange portion 96 of the magazine block 92 is circumferentially moved in the direction of the arrow $r'$ indicated in FIG. 7 and accordingly the magazine block 92 as a whole is rotated about its axis in the direction of the arrow $r$ indicated in FIGS. 5 and 6 through a center angle corresponding to the distance between the respective center lines $m$ and $m'$ of the locking track portion 168*a* and the corner spot 174. It may be noted in this instance that, because the front side guide face 170*a* of the turn-off track portion 170 has its starting end $p$ located on the circumferentially leading side of the center line $m$ of the locking track portion 168*a*, the pin 166 moved out of the locking track portion 168*a* is forcibly and assuredly guided into the turn-off track portion 170 or, in other words, prevented from being misled into the turn-back track portion 172 located on the circumferentially leading side of the locking track portion 168*a*. When the manipulator 144 is released from the forward force applied to the manipulator handle 162, then the manipulator 144 is moved back rearwardly by the force of the preload compression spring 154 so that the pin 166 on the manipulator 144 is caused to move out of the corner spot 174, ride in the turn-back track portion 172 trailing from the corner spot 174, and enter the locking track portion 168 which is located next to and on the circumferentially trailing side of the locking track portion 168*a* from which the pin 166 has started. When the pin 166 is thus being moved along the turn-back track portion 172, the pin 166 is forced against the rear side guide face 172*a* of the turn-back track portion 172 and urges the magazine block 92 axially rearwardly as indicated by an arrow $f'$ in FIG. 7. The flange portion 96 of the magazine block 92 is further moved in the direction of the arror $r'$ and accordingly the magazine block 92 as a whole is further rotated in the direction of the arrow $r$ (FIGS. 5 and 6) through a central angle corresponding to the distance between the respective center lines $n$ and $m$ of the corner spot 174 and the locking track portion 168. The pin 166 moved out of the corner spot 174 is forcibly and assuredly brought into engagement with the rear side guide face 172*a* of the turn-back track portion 172 because the guide face 172*a* has its starting end located on the circumferentially leading side of the center line $m$ of the locking track portion 168. Each time the manipulator 144 is thus moved forwardly and backwardly throughout the distance of its stroke, the pin 166 on the manipulator 144 is caused to ride from one of the locking track portions 168 to another and drives the magazine block 92 to rotate a central angle of $2\pi/n$ about its center axis. As the magazine block 92 is stepwise rotated in this fashion, the pin 166 on the manipulator 144 is repeatedly brought into locking engagement with the magazine block 92 and bring the bores 98 in the magazine block successively into alignment with the through hole 84 in the rear wall portion 66 of the magazine holder 62. When the magazine block 92 is thus stepwise rotated an $n$-1 number of times from the position having the locking track portion 168*s* engaged by the pin 166, the pin 166 is located in the locking track portion 168*t* next to and on the circumferentially leading side of the initial locking track portion 168*s*, having the previously mentioned bore 98*t* in alignment with the through hole 84 in the rear wall portion 66 of the magazine holder 62. When the magazine block 92 is further rotated through an angle of $2\pi/n$, the pin 166 is caused to move out of the track portion 168*t*, ride in the turn-off track portion 170 trailing from the locking track portion 168*t*, reach the corner port 174 contiguous to the retract track portion 176, withdraw axially forwardly from the cam track 164 through the retract track portion 176 and is thereby disengaged from the flange portion 96 of the magazine block 92 when the manipulator 144 is forwardly moved until the valve portion 158 thereof is moved out of the through hole 128 in the rear wall portion 66 of the magazine holder 62. The manipulator 144 is now free to rotate about the axis of the pin 152 away from the magazine block 92.

When the manipulator 144 has its valve portion 158 received in the through hole 128 and is held in its rearmost position by the force of the preloaded compression spring 154, the valve portion 158 is seated on the annular seat member 132 in the hole 128 and thus closes the passageway 130 in the front wall portion 20 of the main body 12, as illustrated in FIG. 3. When, however, the manipulator 144 is moved forwardly at the manipulator handle 162 and accordingly the valve portion 158 received in the hole 128 is unseated from the seat member 132 and is forwardly moved along the port 160 which is open to the hole 128, communication is provided between the passageway 130 and the port 160 so that the passageway 130 is vented to the open air through the hole 128 and the port 160.

Valve means are provided so as to drive the piston 58 for reciprocating motions by the air pressure developed in the pressure accumulating chamber 16. As is schematically and partly illustrated in FIG. 2, the valve means include an actuating valve 178 on the handle portion 14 of the casing structure 10 and an exhaust valve 180 located at a rear part of the main body 12. The actuating valve 178 comprises a valve chamber 182 formed in the wall of the handle portion 14. The valve chamber 182 has an air inlet port 184 providing constant communication between the valve chamber 182 and the pressure accumulating chamber 16 and an air discharge passageway 186 having an inner end open to the chamber 182 and an outer end open to the atmosphere. The actuating valve 178 further comprises an air outlet port 188 which leads from an intermediate part of the air discharge passageway 186. A valve member 190 has a valve stem 192 axially movable through the air discharge passageway 186 and having an inner end portion projecting into the valve chamber 182. The valve stem 192 has carried at its inner end thereof a spherical inner valve head 194 which is positioned within the valve chamber 182 and at the outer end thereof a disc-shaped outer valve head 196. The spherical inner valve head 194 is movable between positions closing and opening the inner end of the air discharge passageway 186, while the disc-shaped outer valve head 196 is movable between positions closing and opening the outer end of the passageway 186. When the spherical inner valve head 194 is in the position opening the inner end of the passageway 186, the disc-shaped outer valve head 196 is held in the position closing the outer end of the passageway 186 so that communication is established between the air inlet and outlet ports 184 and 188 through the valve chamber 182 and the passageway 186. When, as illustrated in FIG. 2, the disc-shaped outer valve head 196 is in the position opening the outer end of the air discharge passageway 186, then the spherical inner valve head 194 is held in the position closing the inner end of the passageway 186 so that the communication between the air inlet and outlet ports 184 and 188 is blocked and, instead, the air outlet port 188 is vented to the open air through the air discharge passageway 186. When compressed air is present in the pressure accumulating chamber 16, the valve member 190 is urged to close the inner end of the passageway 186 by the spherical inner valve head 194 which is acted upon by the pressure developed in the valve chamber 182. A plunger 198 axially projects from the outer face of the disc-shaped outer valve head 196 and is engaged at its leading end by a control lever 200 which is secured at one end to the front wall portion of the main body 12. The control lever 200 is conditioned to allow the valve member 190 in the position closing the air discharge passageway 186 by the spherical inner valve head 194 with the disc-shaped outer valve head 196 held in the position opening the outer end of the discharge passageway 186 when the control lever 200 is in a relaxed condition as illustrated in FIG. 2. When the control lever 200 is squeezed manually or in any other suitable manner, the valve member 190 is moved inwardly so that the disc-shaped outer valve head 196 closes the outer end of the discharge passageway 186 and simultaneously the spherical inner valve head 194 opens the inner end of the discharge passageway 186, providing communication between the air inlet and outlet ports 184 and 188 through the valve chamber 182 and the air discharge passageway 186.

The air outlet port 188 of the actuating valve 178 communicates through the safety valve 300 with the exhaust valve 180 through passageways 189, 203 and 205 which may be formed in the main body 12 though schematically illustrated in FIG. 2 using chain lines. The exhaust valve 180 is positioned within the concavity 36 formed by the rearmost wall portion 34 of the main body 12 and comprises a valve chamber 202 having a center axis preferably in line with the center axis preferably in line with the center axis of the opening 40 in the disc-shaped rear wall portion 38 of the main body 12 and a valve member constituted by a floating piston 204 which is axially slidable in the valve chamber 202 toward and away from the rear face of the disc-shaped rear wall portion 38. The valve chamber 202 is contiguous to an air pressure chamber 206 which is communicable with the air outlet port 188 of the actuating valve 178 through the safety valve 300. The air outlet port 188 of the actuating valve 178 is also communicable through the safety valve 300 with the annular gap between the annular rear end wall 30 of the ring-shaped internal wall portion 26 of the main body 12 and the rear flange portion 48 of the cylinder 44 through the passageways 189, 203 and 205 formed in the main body 12.

The above-mentioned safety valve 300 is adapted to provide communication between the air outlet port 188 of the actuating valve 178 and each of the pressure chamber 206 of the exhaust valve 180 and the annular gap 50 when, and only when, the tool is firmly pressed against the surface of a work at the front end of the cylindrical projection 138 of the front end member 134 (FIGS. 3 and 4). The safety valve 300 comprises a valve member 302 and a valve plunger 304 which are slidably received in line in a valve chamber 306 connecting between the passageways 189 and 203 as shown in FIG. 2. The valve member 302 is urged by a helical compression spring 303 toward the valve plunger 304 so as to sealingly seat on the valve seat portion 308 to block communication between the passageways 189 and 203. The valve chamber 306 is formed with an air discharge port 310 opening to the atmosphere and adapted to cooperate with the valve plunger 304, which can block discharge of air through the air discharge port 310 when displaced toward the valve member 302 against the biasing force preloaded thereto. The safety valve 300 has an actuating mechanism which comprises, as will be best seen in FIG. 4, a press rod 208 extending generally in parallel with the aligned center axis of the through hole 84 in the rear wall portion 66 of the magazine holder 62 and the bore 140 in the cylindrical projection 138 of the front end member 134. The press rod 208 is slidable forwardly and rearwardly partly on the outer peripheral surface of the elongated front wall portion 68 of the magazine holder 62 and partly on the outer peripheral surface of the cylindrical projection 138 of the front end member 134. The front wall portion 68 of the magazine holder 62 is thus formed with a pair of spaced parallel guide walls 210 and 210' on its outer peripheral surface and has slidably received therebetween the side faces of the press rod 208 as will be best seen in FIGS. 5 and 6. The press rod 208 is urged forwardly of the magazine holder 62 by means of a preloaded helical compression spring 212 which is seated at one end on a seat member 214 secured to the rear end portion of the rod 208 and at the other end in a hole 216 which is formed in the rear wall portion 66 of the magazine holder 62. The cylindrical projection 138 is formed with a bracket portion 218 (FIG. 3) and has carried thereon a stop and guide roller 220 for guiding the front end portion of the press rod 208 in parallel with the cylindrical projection 138 and limiting the forward movement of the press rod 208. When the press rod 208 is held in the foremost position thereof, the rod 208 has its front end portion projecting forwardly from the leading end of the projection 138 as seen in FIGS. 3 and 4. When, however, the cylindrical projection 138 of the front end member 134 is firmly pressed against the surface of a work (not shown) during use of the tool, the press rod 208 is moved rearwardly against the force of the preloaded compression spring 212 until the front end of the rod 208 becomes flush with the front end of the cylindrical projection 138. When the cylindrical projection 138 is released from the work, then the press rod 208 is allowed to project forwardly by the force of the spring 212 and assumes its foremost position illustrated in FIGS. 3 and 4. Such reciprocating motions of the press rod 208 are transmitted in a suitable manner to reciprocate the valve plunger 304 of the safety valve 300. When the press rod 208 is retracted into the rearmost position, the valve plunger 304 is correspondingly moved rearwardly to cause the valve member 302 unseated from the valve seat portion 308 and to close the air discharge port 310. Then communication is provided through the passageways 189, 203 and 205 between the air outlet port 188 of the actuating valve 178 and each of the air pressure chamber 206 of the exhaust valve 180 and the annular gap 50 between the rear end wall of the internal wall portion 26 and the rear flange portion 48 of the cylinder 44. Such communication is, however, blocked, and the air discharge port 310 opens to the atmosphere when the front end of the cylindrical projection 138 of the front end member 134 is disengaged from the work and the press rod 208 is allowed to project forwardly from the rearmost position thereof.

The air pressure chamber 206 of the exhaust valve 180 and the annular gap 50 is, thus, brought into communication with the open air when (1) the actuating valve 178 is in a condition opening the air discharge passageway 186 to the atmosphere and/or (2) the safety valve is in a condition opening to the atmosphere through the air discharge port 310 and/or, as will be explained in detail hereinafter, through the air discharge port 160 in the rear wall portion of the manipulator when the magazine block 92 is being dismantled from the magazine holder 62, re-loaded with new fasteners and reassembled to the magazine holder 62. When the pressure chamber 206 of the exhaust valve 180 and the annular gap 50 are open to the atmosphere with at least one of the above-mentioned conditions established, atmospheric pressure occurs in each of the pressure chamber 206 of the exhaust valve 180 and the annular gap 50. In this condition, the floating piston 204 of the exhaust valve 180 is moved away from the rear face of the disc-shaped rear wall portion 38 and thus allows the opening 40 in the wall portion 38 to open in the presence of air pressure inside the wall portion 38 and, at the same time, the cylinder 44 is forced rearwardly of the main body 12 and has its rear end in close contact with the resilient rear seat member 42 on the disc-shaped rear wall portion 38 as shown in FIG. 2 by the air pressure acting on the annular front end face of the rear flange portion 48 and the differential air pressure acting on the front flange portion 46 of the cylinder. The pressure acting on the front end face of the rear flange portion 48 is greater than the differential pressure acting on the front flange 46 because the area of the front end face of the rear flange portion 48 is not less than the differential area of the front flange portion 46.

When, however, the control lever 200 is squeezed with the safety valve 300 in a condition providing the communication between the air outlet port 188 of the actuating valve 178, and each of the pressure chamber 206 of the exhaust valve 180 and the annular gap 50, compressed air is directed from the pressure accumulating chamber 16 into the air pressure chamber 206 of the exhaust valve 180 and the annular air gap 50 through the actuating valve 178, the safety valve 300 and passageways 189, 203 and 205. The air pressure thus developed in the pressure chamber 206 of the exhaust valve 180 acts on the rear face of the floating piston 204 and moves the piston 204 forwardly of the valve chamber 202. The floating piston 204 is therefore caused to seat on the rear face of the disc-shaped rear wall portion 38 of the main body 12 and closes the opening 49 in the wall portion 38. The air pressure developed in the annular gap 50 acts on the annular rear end face of the rear flange portion 48 of the cylinder 44 and urges the cylinder 44 forwardly by a force which is substantially equal to the force urging the cylinder 44 by the air pressure applied to the front end face of the flange portion 48. The cylinder 44 is moved forwardly away from the rear seat member 42 by the differential pressure acting on the front flange portion 46. When the cylinder 44 is thus moved forwardly of the main body 12, the circumferential slot 56 in the cylinder 44 is brought into alignment with the circumferential slot 54 in the main body 12 so that the interior of the cylinder 44 forward of piston 58 is vented to the open air through the aligned slots 54 and 56. The cylinder 44 being unseated from the rear seat member 42, furthermore, communication is provided between the pressure accumulating chamber 16 and the interior of the cylinder 44 rearward of the piston 58 so that the air pressure in the pressure accumulating chamber 16 acts on the rear face of the piston 58, forcing the piston 58 to move forwardly of the cylinder 44 toward the front seat member 70. As the piston 58 is thus moved forward, the hammer rod 60 axially movable with the piston 58 projects forwardly out of the through hole 84 in the rear wall portion 66 of the magazine holder 62 into one of the axial bores 98 in the magazine block 92, striking the fastener 106 in the bore and forcing the fastener forwardly from the position having the head 106*a* retained by the retaining member 102. When the fastener 106 is thus forced forward, the head 106*a* of the fastener 106 is forced through the aperture in the retaining member 102 against the resiliency of the retaining member until the fastener 106 is released from the retaining member. The piston 58 is kept urged forward by the air pressure acting on the rear face thereof and accordingly the hammer rod 60 is forced against the head 106*a* of the fastener 106 insofar as the air pressure in the pressure accumulating chamber 16 is allowed to act on the rear face of the piston 58. When the control lever 200 is released to block the communication between the air inlet and outlet ports 184 and 188 of the actuating valve 178 or the safety valve 300 is rendered into a condition blocking the communication between the air outlet port 188 of the actuating valve 178 and each of the pressure chamber 206 of the exhaust valve 180 and the annular gap 50, then the chamber 206 and the gap 50 are made open to the atmosphere through the air discharge passageway 186 of the actuating valve 178 or through the air discharge port 310 of the safety valve 300. The rear end face of the rear flange portion 48 of the cylinder 44 is now subjected to the atmospheric pressure so that the cylinder 44 is moved rearwardly until the rear end of the cylinder 44 is brought into contact with the rear seat member 42. The opening 40 in the disc-shaped rear wall portion 38 is also made open to the atmosphere with the floating piston 204 of the exhaust valve 180 moved away from the wall portion 38 in the absence of air pressure chamber 206 of the exhaust valve 180. The piston 58 is then moved back rearwardly in the cylinder 44 by air pressure developed in the interior of the cylinder 44 forward of the piston 58. To introduce the compressed air from the pressure accumulating chamber 16 into the cylinder 44 forward of the piston 58, the aforementioned return valve 400 is provided with the safety valve 300 as will be explained hereinafter.

Figure 10A:
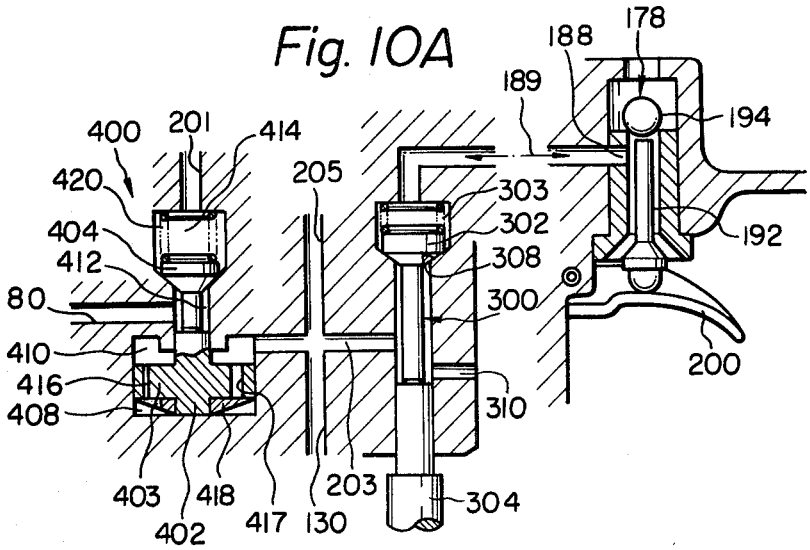
FIGS. 10A and 10D are fragmentary views showing the various operative positions of the valve means incorporated in the percussion tool illustrated in FIGS. 1 and 2.
Figure 10B:
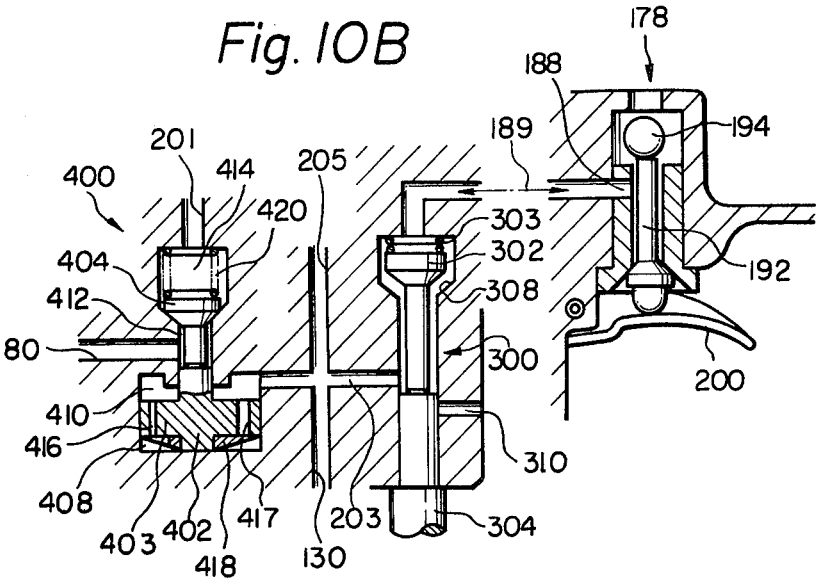
FIG. 10E is a side view showing the left end part of a return valve, as viewed in FIG. 2 of the valve means incorporated in the percussion tool illustrated in FIGS. 1 and 2.
Figure 10C:
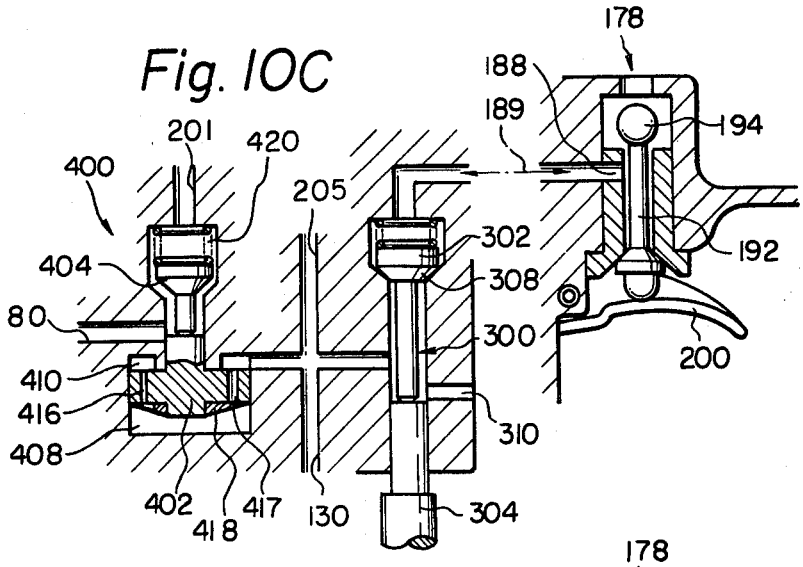
Figure 10D:
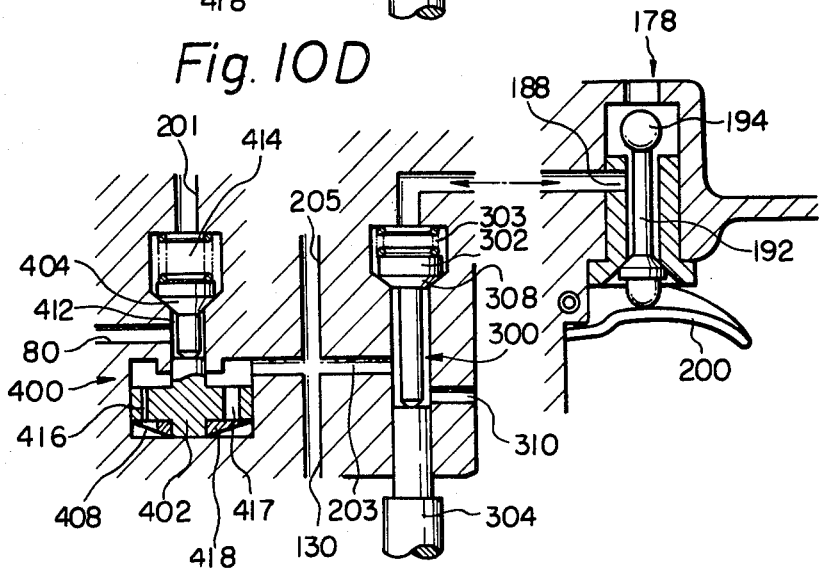
Figure 10E:
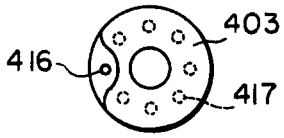

Referring to FIG. 2 and FIGS. 10A and 10E, the return valve 400 comprises a valve member 402 and a valve plunger 404 which are slidably received in line in a elongated return valve chamber 406 which is devided into four compartments. The first and second compartments 408 and 410 of said four compartments are respectively defined at forward and rearward sides of the flange portion 403 of the valve plunger 402, and the third and fourth compartments 412 and 414 are respectively at forward and rearward sides of the enlarged portion of the valve member 404. The first compartment 408 is in constant communication with the second compartment 410 through a needle opening 416. Although a plurality of relatively large openings 417 are provided to further connecting between the first and second compartments 408 and 410, these openings 417 are adapted to cooperate with a check valve device 418 (see FIG. 10E) limiting the flow of air therebetween to one direction from the second compartment 410 to the first compartment 408. The second compartment 410 is in constant communication with the passageway 203 leading to the air discharge port 310 of the safety valve 300. The third chamber 412 is connected to one end of the passageway 80 the other end of which is connected to the annular gap 78. The fourth compartment 414 is constant communication with the pressure accumulating chamber 16. The valve member 404 is at its front end, in abutting engagement with the valve plunger 402 and is urged toward the plunger by a compression spring 420 and the compressed air prevailing in the compartment 414. The valve plunger 402 is so constructed as to move toward the valve member 404 against the force on the rearward end thereof when the compressed air in the second compartment 410 disappears.

The mode of operation of the return valve 400 will be explained particularly with reference to FIGS. 10A and 10D.

FIG. 10A shows the operative positions of the return valve 400 and the safety valve 300 when the percussion tool is not in use. The position of the return valve 400 illustrated in FIG. 10A will be called herein as a first position. In this first position of the return valve 400, the atmospheric pressure is present both in first and second compartments 408 and 410 since the second compartment 410 opens to the atmosphere through the passageway 203 and the air discharge port 310 of the safety valve 300. When, however, the control lever 200 is squeezed with the press rod 208 held in its rearmost position, the air discharge port 310 is closed by the periphery of the valve plunger 304 and communication is established between the pressure accumulating chamber 16 and each of the pressure chamber 206 of the exhaust valve 180 and the annular gap 50 as illustrated in FIG. 10B. In these positions of the safety valve and the return valve 400 in FIG. 10B, the piston 58 and the hammer rod 60 is driven to move forwardly or held in its foremost position to strike the head of the fastener 106 into the work as mentioned hereinbefore. In this instance, the compressed pressure in the accumulating chamber 16 is also fed to the second compartment 410 and therefore to the first compartment 408 mainly through the aforementioned relatively large openings 417 past the check valve device 418. The first compartment 408 thus accumulates compressed air rapidly therein.

When, however, the cylindrical projection 138 of the tool is released from the work and as a result the press rod 208 is allowed to project forwardly as shown in FIG. 2, the pressure in the second compartment 410 is vented to the atmosphere through the passageway 203 and the air discharge port 310 of the safety valve 300 while the accumulated compressed pressure is still present in the first compartment 408 because the accumulated compression air in the first compartment 408 cannot be discharged rapidly into the second compartment 410 through the needle opening 416. The flange portion 403 of the valve plunger 402 is therefore subjected to the pressure differential between the first and second compartments 408 and 410 thereby causing the valve plunger 402 and therefore the valve member 404 to move against the spring 420 and the compressed air in compartment 414. The return valve 400 is thus moved from its first position illustrated in FIG. 2 to the position where it establishes communication between the third and fourth compartments 412 and 414 as illustrated in FIG. 10C. This position of the return valve will be called herein as a second position relative to the aforementioned first position. In this second position of the return valve 400, the compressed air in the air accumulating chamber 16 is supplied to the interior of the cylinder 44 through the annular gap 78 which is now brought into communication with the accumulating chamber 16 through the passageway 80 and 201 and the third and fourth compartments 412 and 414 of the return valve 400. The air pressure is thus directed into the cylinder 44 through the passageway 80 acts on the front face of the piston 58, which is consequently moved rearwardly in the cylinder 44 until the piston 58 is seated on the rear seat member 42 and the hammer rod 60 retracts into the rearmost position thereof. Since the compressed air accumulated in the first compartment 408 of the return valve 400 is being discharged through the needle opening 416 into the second compartment 410 when the atmospheric pressure is present therein, the return valve 400 located in its second position as in FIG. 10C gradually reduces the air pressure in its first compartment 408 and consequently returns to its first position as shown in FIG. 10D in a few seconds after the hammer rod 60 retracts into the rearmost position thereof urged by the force of the spring 420 and the compressed air acting on the rearend of the valve member 404.

The fastener 106 can be repeatedly driven into the work by the hammer rod 60 as the cylindrical projection 138 of the front end member 134 is repeatedly pressed against the work with the control lever 200 squeezed. If, however, the tool is disengaged from the work and/or the control lever 200 is not squeezed, the compression air in the accumulating chamber 16 can not be supplied to the pressure chamber 206 and the annular gap 50 and accordingly the fastener 106 is prevented to be driven forward.

The individual fasteners 106 loaded on the magazine holder 92 are brought into alignment with the hammer rod 60 by moving the manipulator 144 first in forward direction and thereafter in rearward direction so that the magazine block 92 is stepwise rotated about its axis in a manner previously described in detail. When the manipulator 144 is thus moved forwardly of the magazine block 92, the valve portion 158 of the manipulator 144 is moved forwardly away from the front end of the front wall portion 20 of the main body 12 and, as a consequence, the passageway 130 connected to the passageway 205 in the wall portion 20 is allowed to open at the front end of the wall portion and is vented to the atmosphere through the hole 128 and the air discharge port 160 in the rear wall portion 66 of the magazine holder 62. Communication is therefore provided between the atmosphere and each of the air pressure chamber 206 and the annular gap 50 and the tool is disabled to operate insofar as the manipulator 144 is held in a forwardly moved position. When all the fasteners 106 initially loaded on the magazine block 92 are used up, the magazine block 92 assumes an angular position having the previously specified bore **98*t* in alignment with the through hole 84 in the rear wall portion 66 of the magazine holder 62. If the manipulator 144 is forwardly moved under this condition, the pin 166 on the manipulator 144 is caused to ride in the turn-off track portion 170 leading from the axial locking track portion 168*t* diametrically opposed to the bore 98*t* and move into the retract track portion 176 of the cam track 164 formed in the rear flange portion 96 of the magazine block 92 and is thus disengaged from the flange portion 96 (FIGS. 3 and 6). The valve portion 158 of the manipulator 144 is now moved out of the through hole 128 in the rear wall portion 66 of the magazine holder 62 and, as a consequence, the manipulator 144 is free to turn away from the magazine block 92 about the axis of the pin 152 diametrically passed through the elongated slots 150 and 150' (FIG. 5) in the rod portion 146 of the manipulator. When the magazine block 92 is rotated to have the retract track portion 176 of the cam track 164 engaged by the pin 166 on the manipulator 144, the radial groove 114 in the boss 108 of the magazine block 92 is directed toward the circumferentially middle part of the semicylindrical rear inner surface 90 of the magazine holder 62 as will be understood from the illustration of FIG. 6. When the manipulator 144 is moved away from the magazine block 92 about the axis of the above-mentioned pin 152, the magazine block 92 in such an angular position can be readily dismantled from the magazine holder 62 because the magazine block 92 can be moved clear of the plunger 122 projecting forwardly from the front end of the rear wall portion 66 of the magazine holder 62 (FIG. 4). Upon completion of the re-loading of the magazine block 92 which has been thus dismantled from the magazine holder 62, the magazine block 92 can be mounted on the magazine holder by moving the magazine block toward the inner surfaces 88 and 90 of the magazine holder 62 with the abovementioned radial groove 114 directed toward the circumferentially middle part of the rear inner surface 90 of the magazine holder 62 so that the plunger 122 projecting from the rear wall portion 66 of the magazine holder first rides in the radial groove 144 and then on the diametrically opposed portion of the boss 108 of the magazine block 92. When the magazine block 92 is assembled to the magazine holder 62 in this manner, the magazine block 92 assumes an angular position having the retract track portion 176 of the cam track 164 located to be engageable with the pin 166 on the manipulator 144 which is, in this condition, held in a position angularly spaced apart from the magazine block 92. When the manipulator 144 is then turned toward the magazine block 92 about the axis of the pin 152, the pin 166 on the intermediate portion 156 of the manipulator 144 is received in the retract track portion 176 of the cam track 164 in the magazine block 92. When the manipulator 144 is then moved by the force of the compression spring 154 housed in the manipulator, the pin 166 enters the turn-back track portion 172 leading from the retract track portion 176 and rides into the axial locking track portion 168*s* on the trailing side of the above-mentioned locking track portion 168*t* as the magazine block 92 is rotated about its axis through a central angle between the respective center lines of the retract and locking track portion 176 and 168*s* (FIG. 7). The magazine block 92 thus assumes an angular position having the bore 98*s* in alignment with the through hole 84 in the rear wall portion 66 of the magazine holder 62. When the magazine block 92 is being dismantled from the magazine holder 62, re-loaded with new fasteners and reassembled to the magazine holder 62, the safety valve 300 is vented to the atmosphere through the passageways 203 and 130 in the front wall portion 20 of the main body 12 and the through hole 128 and air discharge port 160 in the rear wallportion 66 of the magazine holder 62 with the valve portion 158 of the manipulator 144 disengaged from the wall portion 66 of the magazine holder 62. The piston 58 is therefore kept disabled from being initiated into reciprocating motion even though the control lever 200 is accidentally squeezed with the cylindrical projection 138 of the front end member 134** firmly pressed onto a work or any other hard object.

Figure 8:
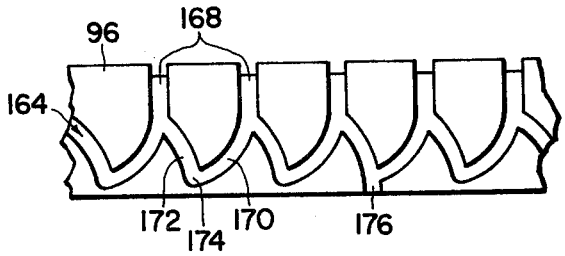
FIG. 8 is a view similar to FIG. 7 but shows a modification of the cam track arrangement illustrated in FIG. 7.
Figure 9:
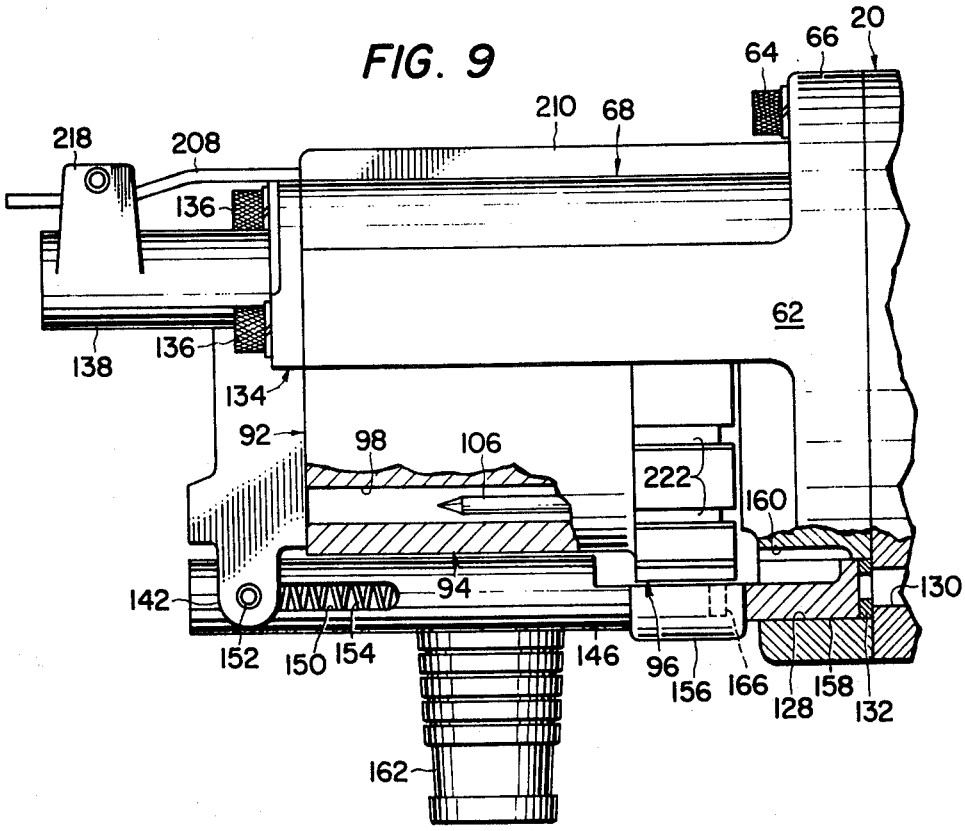
FIG. 9 is a view similar to FIG. 3 but shows a front part of another preferred embodiment of the power driven percussion tool according to the present invention.

While the turn-off and turn-back track portions 170 and 172 of the cam track 164 in the flange portion 96 of the magazine block 92 are shown in FIG. 7 as extending straight when developed on a flat plane, the same may be slightly curved forwardly and rearwardly, respectively, of the magazine block 92 as indicated in FIG. 8 so that an increased driving torque is imparted to the magazine block 92 when the pin 166 on the manipulator 144 is caused to ride in the turn-off and turn-back track portions 170 and 172 thus curved. As an alternative to the cam track 164 thus arranged in a generally zigzag form, the flange portion 96 of the magazine block 92 may be formed with a plurality of axial grooves 222 which are parallel with the center axis of the magazine block 92 and which are open at the front and rear ends of the flange portion 96, as illustrated in FIG. 9. The grooves 222 are equidistantly spaced apart from each other circumferentially of the flange portion 96 and are radially aligned with the individual bores 98 in the magazine block 92 as is the case with the axial locking track portions 168 of the cam track 164 formed in the magazine block 92 shown in FIGS. 3, 5 and 6. When the magazine block 92 is held in an angular position having one of the bores 98 in alignment with the previously mentioned through hole 84 (FIG. 4) in the rear wall portion 66 of the main body 12, the pin 166 projecting from the intermediate portin 156 of the manipulator 144 is received in the axial groove 222 located in diametrically opposed relationship to the particular groove 222 and locks the magazine block 92 in the particular angular position. When the manipulator 144 is moved forwardly of the magazine block 92, the pin 166 is moved forwardly out of the groove 222 so that the magazine block 92 is allowed to freely turn about its center axis. Thus, the bores 98 in the magazine block 92 can be successively brought into alignment with the hole 84 in the magazine holder 62 by manually rotating the magazine block 92 into angular positions having the grooves successively aligned with the pin 166 on the manipulator 144.

The axial locking track portions 168 of the cam track 164 of the magazine block 92 of the embodiment shown in FIGS. 1 to 8 and the axial grooves 222 formed in the magazine block 92 of the embodiment shown in FIG. 9 have been described as being radially aligned with the individual bores 98 in the magazine blocks 92 but, the locking track portions 168 and/or the grooves 222 may be arranged in a spaced relationship with respect to the bores 98 other than the arrangement shown in the embodiment if it is desirable to locate the pin 166 in a position other than shown.

What is claimed is:

1. A percussion tool for driving an elongated fastener, comprising reciprocating drive means for striking an elongated fastener at one end thereof in a forward direction when actuated, a generally cylindrical magazine block rotatable about an axis substantially parallel with said direction and having a plurality of axial bores parallel with the axis of the magazine block and arranged substantially in symmetry about and with respect to said axis for being successively brought into alignment with said direction when the magazine block is stepwise rotated about said axis, each of said bores being adapted to releasably retain an elongated fastener therein, a magazine holder for detachably supporting said magazine block thereon while allowing the magazine block to rotate about said axis, and a manipulator movable relative to said magazine block and said magazine holder between a first position operative to hold the magazine block in a rotational position having one of said bores aligned with said direction, a second position operative to hold the magazine block in a rotational position having one of said bores misaligned with said direction and a third position allowing the magazine block to be detached from said magazine holder.

2. A percussion tool as set forth in claim 1, further comprising pressure accumulating means for storing therein fluid under pressure, and valve means operative to apply the fluid under pressure onto said drive means for actuating the drive means into reciprocating motion, said valve means including a fluid discharge valve responsive to the movement of said manipulator out of said first position thereof for discharging the fluid under pressure out of said valve means and disabling said drive means from being actuated into said reciprocating motion.

3. A percussion tool as set forth in claim 1, in which said magazine block has a flange portion formed with a continuous cam track extending generally in zigzag form round the entire circumference of the flange portion and in which said manipulator has fixedly secured thereto a pin engaging said cam track when the manipulator is in the first or second position thereof, said magazine block being forcibly rotated about its axis into rotational positions having said bores successively aligned with said direction when said manipulator is moved between said first and second positions thereof.

4. A percussion tool as set forth in claim 3, in which said manipulator is movable between said first and second positions thereof in a direction substantially parallel with the axis of said magazine block, said first position being rearward of said second position.

5. A percussion tool as set forth in claim 4, in which said cam track consists of axial locking track portions parallel with the axis of the magazine block, provided in a number equal to the number of said bores and spaced apart from each other circumferentially of said flange portion through central angles respectively equal to the central angles between said bores, turnoff track portions respectively extending obliquely and forwardly from said locking track portions, turnback track portions respectively merging obliquely and rearwardly out of said turn-off track portions, each of said turn-back track portions merging into the locking track portion next to that locking track portion in which the turn-off track portion merging into the turnback track portion originates, intermediate corner spots each joining the adjacent turn-off and turn-back track portions, and a retract track portion extending axially forwardly from one of said corner spots and terminating at the front end of said flange portion.

6. A percussion tool as set forth in claim 5, in which each of said turn-off track portions has a front side guide face having a rearmost end offset from the center line of the adjacent locking track portion on the leading side of the center line in the direction of rotation of the magazine block and each of said turn-back track portions has a rear side guide face having a foremost end offset from the center line of the adjacent corner spot on the trailing side of the center line of the corner spot.

7. A percussion tool as set forth in claim 5, in which each of said turn-off track portions and each of said turn-off track portions extend substantially straight when said cam track is developed on a flat plane.

8. A percussion tool as set forth in claim 5, in which each of said turn-off track portions is curved forwardly and each of said turn-back track portions is curved rearwardly of said magazine block.

9. A percussion tool as set forth in claim 1, in which said magazine block has a boss formed with a hole coaxial with the magazine block and a radial groove open at both ends and in which said magazine holder has carried thereon a plunger biased to project into said hole, said magazine block being retained to said magazine holder through engagement between said boss and said plunger and detachable from the magazine holder when said radial groove is directed opposite to the direction in which the magazine block is moved away from the magazine holder and said plunger disengaged from said boss.

10. A percussion tool as set forth in claim 1, in which said manipulator is rotatable between said second and third positions thereof about an axis perpendicular to the axis of said magazine block.

11. A percussion tool as set forth in claim 1, further comprising biasing means for urging said manipulator from said second position toward said first position.

12. A percussion tool as set forth in claim 1, further comprising resilient retaining means detachably mounted on said magazine block for releasably retaining a fastener in each of said bores in the magazine holder.

13. A percussion tool for driving an elongated fastener, comprising reciprocating drive means for striking an elongated fastener at one end thereof in a forward direction when actuated, a generally cylindrical magazine block rotatable about an axis substantially parallel with said direction and having a plurality of axial bores parallel with the axis of the magazine block and arranged substantially in symmetry about and with respect to said axis for being successively brought into alignment with said direction when the magazine block is stepwise rotated about said axis, each of said bores being adapted to releasably retain an elongated fastener therein, a magazine holder for detachably supporting said magazine block thereon while allowing the magazine block to rotate about said axis, and a manipulator movable relative to said magazine block and said magazine holder between a first position operative to hold the magazine block in a rotational position having one of said bores aligned with said direction, a second position allowing the magazine block to rotate about said axis and a third position allowing the magazine block to be detached from said magazine holder.

14. A percussion tool as set forth in claim 13, further comprising pressure accumulating means for storing therein fluid under pressure, and valve means operative to apply the fluid under pressure onto said drive means for actuating the drive means into reciprocating motion, said valve means including a fluid discharge valve responsive to the movement of said manipulator out of said first position thereof for discharging the fluid under pressure out of said valve means and disabling said drive means from being actuated into said reciprocating motion.

15. A percussion tool as set forth in claim 13, in which said magazine block has a flange portion formed with axial grooves parallel with the axis of the magazine block, provided in a number equal to the number of said bores, spaced apart from each other circumferentially of said flange portion through central angles respectively equal to the central angles between said bores, and terminating at the front end of said flange portion and in which said manipulator is movable between said first and second positions thereof in a direction substantially parallel with the axis of said magazine block, said first position being rearward of said second position, said manipulator having fixedly secured thereto a pin engageable with any one of said grooves when said manipulator is in said first position or being moved between the first and second positions thereof.

16. A percussion tool as set forth in claim 13, in which said magazine block has a boss formed with a hole coaxial with the magazine block and a radial groove open at both ends and in which said magazine holder has carried thereon a plunger biased to project into said hole, said magazine block being retained to said magazine holder through engagement between said boss and said plunger and detachable from the magazine holder when said radial groove is directed opposite to the direction in which the magazine block is moved away from the magazine holder and said plunger disengaged from said boss.

17. A percussion tool as set forth in claim 13, in which said manipulator is rotatable between said second and third positions thereof about an axis perpendicular to the axis of said magazine block.

18. A percussion tool as set forth in claim 13, further comprising biasing means for urging said manipulator from said second position toward said first position.

19. A percussion tool as set forth in claim 13, further comprising resilient retaining means detachably mounted on said magazine block for releasably retaining a fastener in each of said bores in the magazine holder.

* * * * *